United States Patent [19]

Frost

[11] 4,401,580

[45] Aug. 30, 1983

[54] LUBRICANT COMPOSITION CONTAINING AN ALKALI METAL BORATE AND AN ESTER-POLYOL COMPOUND

[75] Inventor: Kenneth Frost, San Rafael, Calif.

[73] Assignee: Chevron Research Company, San Francisco, Calif.

[21] Appl. No.: 365,755

[22] Filed: Apr. 5, 1982

Related U.S. Application Data

[63] Continuation-in-part of Ser. No. 182,535, Aug. 29, 1980, abandoned.

[51] Int. Cl.[3] ..... C10M 1/26

[52] U.S. Cl. ..... 252/25; 252/49.6; 252/56 R

[58] Field of Search ..... 252/49.6, 56 R, 25

[56] References Cited

U.S. PATENT DOCUMENTS

| | | | |
|---|---|---|---|
| 3,819,521 | 6/1974 | Sims | 252/25 |
| 3,997,454 | 12/1976 | Adams | 252/25 |
| 4,066,789 | 1/1978 | Mores et al. | 252/56 R |

*Primary Examiner*—Jacqueline V. Howard

*Attorney, Agent, or Firm*—D. A. Newell; J. M. Whitney; J. J. DeYoung

[57] ABSTRACT

Disclosed is a lubricant composition containing an oil of lubricating viscosity having dispersed therein a particulate hydrated alkali-metal borate and an effective amount of a ester-polyol compound which stabilizes the composition against the adverse effects of water contamination.

7 Claims, No Drawings

LUBRICANT COMPOSITION CONTAINING AN ALKALI METAL BORATE AND AN ESTER-POLYOL COMPOUND

CROSS-REFERENCE TO RELATED APPLICATIONS

This application is a continuation-in-part of Ser. No. 182,535, filed Aug. 29, 1980, now abandoned the entire disclosure of which is incorporated herein by reference.

BACKGROUND OF THE INVENTION

The invention relates to extreme pressure lubricating oils, particularly alkali metal borate-containing lubricants.

Alkali metal borate-containing lubricants are well known in the art for their usefulness as extreme pressure lubricating oils. See, for example, U.S. Pat. Nos. 3,313,727, 3,565,802, 3,819,521, 3,846,313, 3,853,772, 3,907,691, 3,912,639, 3,912,643, 3,912,644, 3,997,454, and 4,089,790.

The borate-containing oils, described in these patents, have a serious deficiency in service. If water is introduced into the system containing the borate lubricant, the borate crystallizes out of the oil and forms hard granules. This crystallization decreases the extreme pressure function of the lubricant. Furthermore, it has been found that water contamination of the borate lubricant can lead to seal leakage. It is believed that the crystallization is caused by water contamination which leads to the formation of deposits on shafts at or near the seals. The turning motion of the shafts then slowly abrades the seals, thereby allowing loss of the lubricant.

U.S. Pat. No. 3,997,454 claims a hydrated potassium borate with a boron-to-potassium ratio of 2.5 to 3.5 as being superior to other alkali metal borates in resisting the adverse effects of water contamination.

U.S. Pat. No. 3,819,521 claims a lubricant composition containing a hydrated sodium borate and a $C_3$–$C_6$ polyol containing two to six hydroxyl groups. This patent teaches the use of borate at concentrations of 2 to 25 parts by weight for each 75 to 100 parts oil which is essentially 2 to 25% by weight borate. The concentration of the $C_3$–$C_6$ polyol is 0.3 to 1.0 parts per part of borate which is essentially 0.6 to 20 percent by weight of $C_3$–$C_6$ polyol.

It is one object of the present invention to provide an alkali metal borate-containing lubricant having improved resistance to the adverse effects of water contamination.

SUMMARY OF THE INVENTION

It has been found that the addition of an effective amount of an ester-polyol compound to a lubricating oil containing an alkali metal borate prevents the accumulation of seal damaging deposits caused by water contamination of the lubricant.

DETAILED DESCRIPTION OF THE INVENTION

The present invention is an improvement over the invention disclosed in the aforementioned U.S. Pat. No. 3,819,521, the entire disclosure of which is incorporated herein by reference. The lubricant composition of the invention comprises an oil or lubricating viscosity, particulate hydrated alkali metal borate and an effective amount of an ester-polyol compound.

THE ALKALI-METAL BORATES

The hydrated particulate alkali-metal borates are well known in the art and are available commercially. Representative patents disclosing suitable borates and methods of manufacture include: U.S. Pat. Nos. 3,313,727; 3,819,521; 3,853,772; 3,907,601; 3,997,454; and 4,089,790, the entire disclosures of which are incorporated herein by reference.

The hydrated alkali-metal borates can be represented by the following formula:

$$M_2O.mB_2O_3.nH_2O$$

where M is an alkali metal of atomic number in the range 11 to 19, i.e., sodium and potassium, m is a number from 2.5 to 4.5 (both whole and fractional), and n is a number from 1.0 to 4.8. Preferred are the hydrated potassium borates, particularly the hydrated potassium triborates microparticles having a boron-to-potassium ratio of about 2.5 to 4.5. The hydrated borate particles generally have a mean particle size of less than 1 micron.

The alkali-metal borate will generally comprise 0.1 to 60 weight percent of the lubricant, preferably 0.5 to 15 weight percent.

THE ESTER-POLYOL COMPOUNDS

The lubricant composition contains an effective amount of an ester-polyol compound containing at least 10 carbon atoms to prevent the accumulation of seal damaging borate deposits caused by water contamination of the lubricant. Generally the ester-polyol compound will contain 10 to 30 carbon atoms, preferably 12 to 24 carbon atoms. Generally the lubricant will contain 0.25 to 2.5 weight percent of the ester-polyol compound and preferably 0.25 to 0.50 weight percent.

Representative ester-polyol compounds include: pentaerythritol monooleate, glycerol monoricinoleate, sorbitan monolaurate, sorbitan tristearate, trimethylolmethane monocerotate, and 2,2-dimethyloleicosyl acetate.

Preferred ester-polyol compounds may be represented by the following formula:

$$(HO)_d(C_nH_{2n+2-b-d})(OCOR)_b$$

wherein:

n is 3 to 30 b is 1 to 4 d is 2 to 5

R is an aliphatic hydrocarbyl of 1 to 30 carbons.

The aliphatic hydrocarbyl groups useful in this invention are saturated or unsaturated, essentially linear, hydrocarbon groups. Preferred are the ester-polyol compounds where n is 3 to 20 and more preferably 3 to 6, b is 1 to 3, d is 2 or 4, and R is an alkyl of 1 to 20 carbon atoms.

The lubricating oil to which the borates and the ester-polyol compound are added, can be any hydrocarbon-based lubricating oil or a synthetic base oil stock. The hydrocarbon lubricating oils may be derived from synthetic or natural sources and may be paraffinic, naphthenic or asphaltic base, or mixtures thereof. A variety of other additives can be present in lubricating oils of the present invention. These additives include antioxidants, viscosity index improvers, dispersants, rust inhibitors, foam inhibitors, corrosion inhibitors, other antiwear agents, and a variety of other well-known additives. Particularly preferred additional additives are the oil-soluble succinimides and oil-soluble alkali or alkaline earth metal sulfonates.

EXAMPLES

To 100 ml samples of a base oil containing 9 weight percent of a potassium triborate dispersion, 1.0 weight percent of a diparaffin polysulfide, 0.5 weight percent zincdialkyldithiophosphate, and 0.5 weight percent of a phenolic antioxidant were added various amounts of ester-polyol compounds of the present invention. For comparison purposes, various $C_3$–$C_6$ polyhydroxy compounds as taught in U.S. Pat. No. 3,819,521 were also tested. Each sample was tested in a seal leakage apparatus comprising a sealed motor driven metal shaft passing through a reservoir of test oil. The seal comprised a Chicago Rawhide 10700 lip seal. Provisions were made for collecting any oil leakage. The shaft was rotated at 3200 revolutions per minute in each test. Each experiment was four hours long, started at room temperature, and test oil temperature rose to 60° C. (140° F.) in the first 30 minutes. New Chicago Rawhide 10700 lip seals were used for each test. After each experiment was complete, the amount of oil leakage, the seal wear, the shaft deposit weight, and the presence of ridges at the seal shaft contact line were recorded. Shaft ridges were evaluated visually and tactically and rated as none, light, moderate, or heavy. Formulations showing none or light ridges are considered satisfactory. The water concentration in each test was 1 percent by weight except as noted in the Table I. The results are reported in Table I.

TABLE I

PROPERTIES OF BORATE DISPERSION CONTAINING WATER

| Additive | Hydroxyl groups, moles × 100 | Seal Wear, $10^{-3}$ In. | Deposit Weight, mg | Leakage, ml | Shaft Ridges |
|---|---|---|---|---|---|
| None (no water) | — | 14 | 0 | 0 | none |
| None (no water) | — | 13 | 0 | 0 | none |
| None | — | 24 | 30 | Trace | heavy |
| 0.35% glycerol (prior art) | 1.05 | 22 | 27 | 0 | moderate/ heavy |
| 0.5% glycerol (prior art) | 1.5 | 10 | 11 | 0 | light |
| 0.15% trimethylol propane (prior art) | 0.33 | 11 | 9 | Trace | none |
| 0.25% trimethylol propane (prior art) | 0.55 | 5 | 5 | 0 | none |
| 0.5% trimethylol propane (prior art) | 1.11 | 14 | 3 | 0 | none |
| 0.25% pentaerythritol monooleate | 0.187 | 15 | 20 | Trace | moderate/ heavy |
| 0.40% pentaerythritol monooleate | 0.30 | 6 | 5 | 0 | none |
| 0.50% pentaerythritol monooleate | 0.375 | 8,10,5 | 8,8,5 | 0 | none |
| 0.5% glycerol monoricinoleate | 0.45 | 15 | | 0 | none |
| 0.2% sorbitan monolaurate | 0.28 | 7 | | 0 | light |
| 0.5% sorbitan monolaurate | 0.70 | 6 | | 0 | none |
| 0.25% sorbitan monooleate | 0.27 | 18 | | 3 | moderate/ heavy |
| 0.50% sorbitan monooleate | 0.55 | 7 | | 0 | none |

The above data demonstrates that water contamination of a borate-containing lubricant causes substantial seal deterioration due to deposits formed in ridges at the seal shaft contact line which eventually leads to seal leakage whereas the ester-polyol compounds of the present invention are effective in substantially improving the water contamination resistance of an alkali-metal borate-containing lubricant. Furthermore, the ester-polyol compounds of the present invention are more efficient than the prior art $C_3$–$C_6$ polyols of Sims U.S. Pat. No. 3,819,521. Based upon the concentration of hydroxyl groups in the additive, the compounds of the present invention are surprisingly more effective. As shown in Table I glycerol at 0.5 weight percent concentration is equivalent to 1.5 moles of hydroxyl whereas pentaerythritol monooleate at the same concentration has only 0.37 moles of hydroxyl group, that is, one-fourth as many hydroxyls. Yet, the effectiveness of the pentaerythritol monooleate is superior in reducing deposits, preventing leakage, and in preventing the development of shaft ridges.

What is claimed is:

1. A lubricant composition comprising an oil of lubricating viscosity having dispersed therein:

(a) 0.1 to 60 weight percent of a particulate hydrated alkali-metal borate and (b) an effective amount of an ester-polyol compound to prevent the accumulation of seal damaging borate deposits.

2. The lubricant composition of claim 1 having dispersed therein 0.25 to 2.5 weight percent of said ester-polyol compound, and wherein said ester-polyol compound contains at least 10 carbon atoms.

3. The lubricant composition of claim 1 having dispersed therein 0.25 to 0.50 weight percent of said ester-polyol compound, and wherein said ester-polyol compound contains 12 to 24 carbon atoms.

4. The lubricant composition of claim 1, 2 or 3 wherein said ester-polyol compound is selected from sorbitan monooleate, pentaerythritol monooleate, sorbitan monolaurate, or glycerol monoricinoleate.

5. The lubricant composition of claim 1 wherein said ester-polyol cmpound is of the formula:

$$(HO)_d(C_nH_{2n+2-b-d})(OCOR)_b$$

wherein:

n is 3 to 30 b is 1 to 4 d is 2 to 5

R is an aliphatic hydrocarbyl of 1 to 30 carbon atoms.

6. The lubricant composition of claim 5 wherein in the formula n is 3 to 6, b is 1 to 3, d is 2 to 4 and R is an alkyl of 1 to 20 carbon atoms.

7. The lubricant composition of claim 6 having dispersed therein 0.25 to 0.50 weight percent of said ester-polyol compound.

* * * * *